US005619749A

United States Patent [19]

Banuchi

[11] Patent Number: 5,619,749

[45] Date of Patent: Apr. 15, 1997

[54] ANTIPHOTOAGING FACE MASK

[76] Inventor: Isabel M. Banuchi, Avenida Domenech 302, Hato Rey, Puerto Rico, 00918

[21] Appl. No.: 524,902

[22] Filed: Sep. 7, 1995

[51] Int. Cl.[6] ..... A41D 13/00

[52] U.S. Cl. ..... 2/9; 2/13; 2/427

[58] Field of Search ..... 2/8, 9, 2, 7, 424, 2/10, 11, 13, 12, 427, 428, 429, 448, 450, 431, 206, 15; 351/155, 158

[56] References Cited

U.S. PATENT DOCUMENTS

| | | | |
|---|---|---|---|
| 1,176,313 | 3/1916 | Pfund | 2/8 |
| 1,199,529 | 9/1916 | Collman . | |
| 1,298,223 | 3/1919 | Kemp | 2/206 |
| 1,911,817 | 5/1933 | DuBois | 2/9 |
| 2,344,920 | 3/1944 | Maggi | 2/9 |
| 2,655,656 | 10/1953 | Moeller | 2/8 |
| 2,669,717 | 2/1954 | Diggs | 2/9 |
| 2,774,970 | 12/1956 | Du Bois | 2/9 |
| 3,298,031 | 1/1967 | Morgan | 2/9 |
| 3,423,763 | 1/1969 | Schwartz | 2/9 |
| 3,763,495 | 10/1973 | De Angelis | 2/8 |
| 3,868,727 | 3/1975 | Paschall | 2/8 |
| 3,943,574 | 3/1976 | Yamaguchi et al. | 2/9 |
| 3,991,753 | 11/1976 | Viesca y Viesca | 2/9 |
| 4,821,340 | 4/1989 | Johnson | 2/9 |
| 4,888,825 | 12/1989 | Hakala et al. | 2/8 |
| 4,924,526 | 5/1990 | Parissenti et al. | 2/13 |
| 4,937,880 | 7/1990 | Beard | 2/427 |
| 4,944,039 | 7/1990 | Dietrich | 2/13 |
| 4,965,887 | 10/1990 | Paoluccio et al. | 2/9 |
| 5,247,706 | 9/1993 | Mark | 2/9 |
| 5,365,615 | 11/1994 | Piszkin | 2/424 |
| 5,379,463 | 1/1995 | Schleger et al. | 2/449 |

*Primary Examiner*—Amy B. Vanatta
*Attorney, Agent, or Firm*—Parkhurst, Wendel & Burr, L.L.P.

[57] ABSTRACT

An antiphotoaging face mask including a pair of sunglasses comprising a front frame member and a pair of temples extending therefrom. The antiphotoaging face mask includes a flexible plastic wrap secured to the pair of sunglasses, the wrap including a front portion that extends over the nose of the wearer, as well as lateral side portions to cover at least lateral aspects of the head of the wearer. The flexible plastic wrap includes a layer of transparent plastic material that blocks at least harmful UV rays.

6 Claims, 4 Drawing Sheets

ANTIPHOTOAGING FACE MASK

BACKGROUND OF THE INVENTION

The present invention is drawn to a face mask to protect one's face against harmful effects of UVA, UVB and UVC radiation from the sun. The present invention has been developed to prevent, reduce and help to counteract sun-induced dermatosis for people who are generally exposed to the sun, and takes on particular significance in view of the increased awareness of sun-induced diseases and lack of protection caused by depletion of the ozone layer.

Conventionally, people take advantage of lotion-type sunscreens to prevent excessive exposure to the sun. However, many people suffer from ache, eye irritability, allergic reactions, etc. due to application of sunscreens on the face. In addition, sunscreens tend to require constant reapplication, and present a greasy or sticky appearance. Accordingly, the present invention has been developed to overcome such disadvantages.

PRIOR ART

U.S. Pat. No. 2,669,717 to Diggs discloses a protective article including combined sunglasses and a face protector. The Diggs article utilizes a pair of sunglasses and woven fabric hanging therefrom so as to cover the nose, mouth and a portion of lateral aspects of the head of the wearer. The disclosed article suffers from numerous drawbacks. For example, the fabric is not transparent and shields the face of the wearer from vision, which may be aesthetically undesirable. In addition, although light and thin fabrics are suggested for the face protector, such fabrics tend to be hot and provide inadequate ventilation.

Accordingly, the present invention has been developed to meet not only the deficiencies described above with respect to sunscreens, but also to overcome the drawbacks associated with the known device combining sunglasses and a face protector mentioned above in U.S. Pat. No. 2,669,717.

SUMMARY OF THE INVENTION

To meet the objectives discussed above, the present invention provides an antiphotoaging face mask including a pair of sunglasses comprising a front frame member and a pair of temples extending from the front frame member and a flexible plastic wrap that covers the face of the wearer. The flexible plastic wrap includes a front portion that extends over the nose of the wearer and lateral side portions that cover at least lateral aspects (cheeks) of the head of the wearer. The flexible plastic wrap comprises a layer of transparent plastic material that blocks at least harmful UV rays.

Preferably, the plastic wrap has tiny perforations to permit moisture to escape. The flexible plastic wrap may be extended to cover the forehead, earlobes, chin, etc., of the wearer. A particularly effective antiphotoaging mask utilizes a pair of sports-type sunglasses having an arcuate front frame member that holds a one-piece lens extending therefrom. In this embodiment, preferably the flexible plastic wrap is secured to an outer periphery of the one-piece lens, and extends along the temples to provide protection for the lateral aspects of the head of the wearer.

BRIEF DESCRIPTIONS OF THE DRAWINGS

DETAILED DESCRIPTION OF THE DRAWINGS

Figure 1:
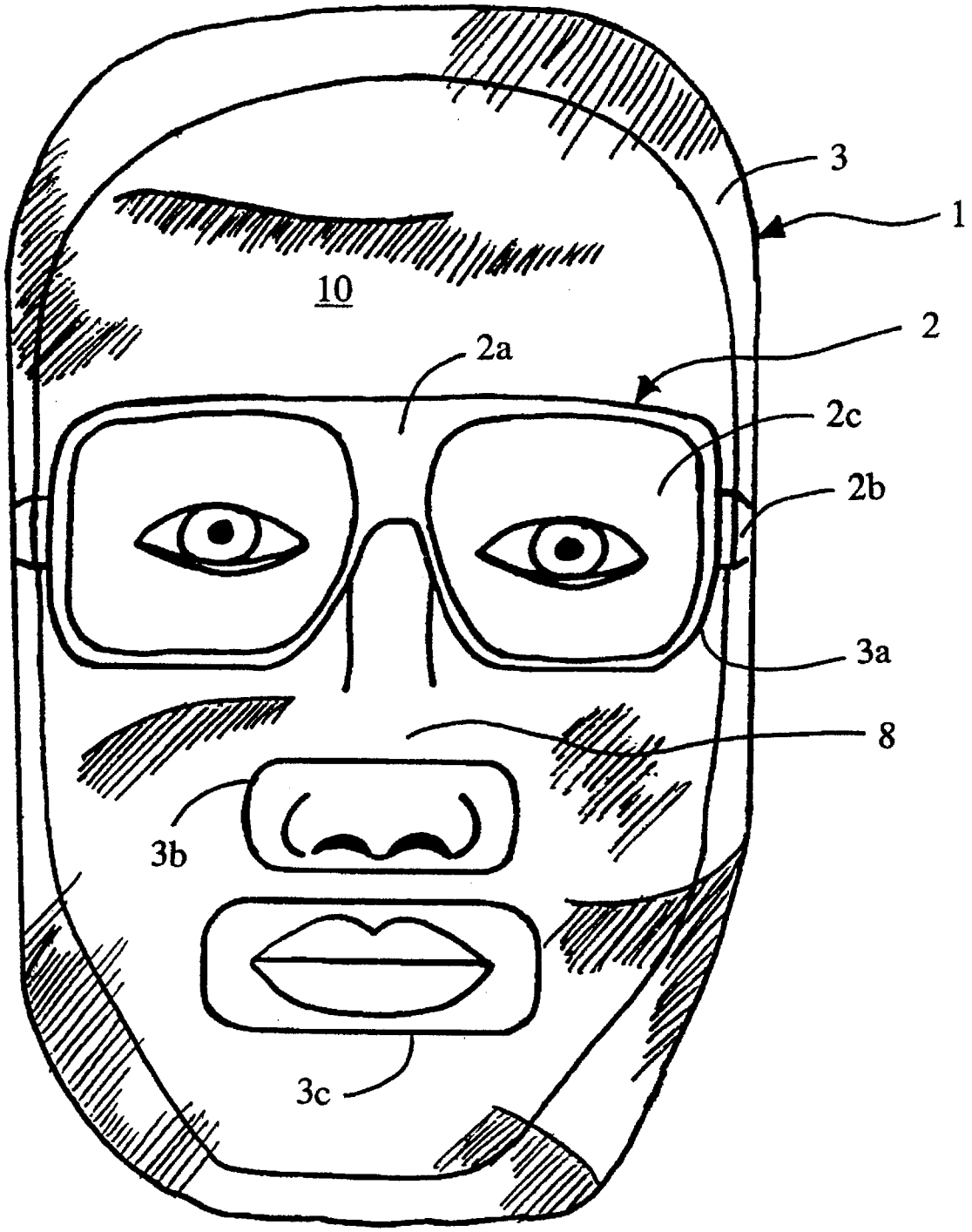
FIG. 1 is a front view of a first embodiment of the present antiphotoaging face mask, shown donned by a wearer.
Figure 2:
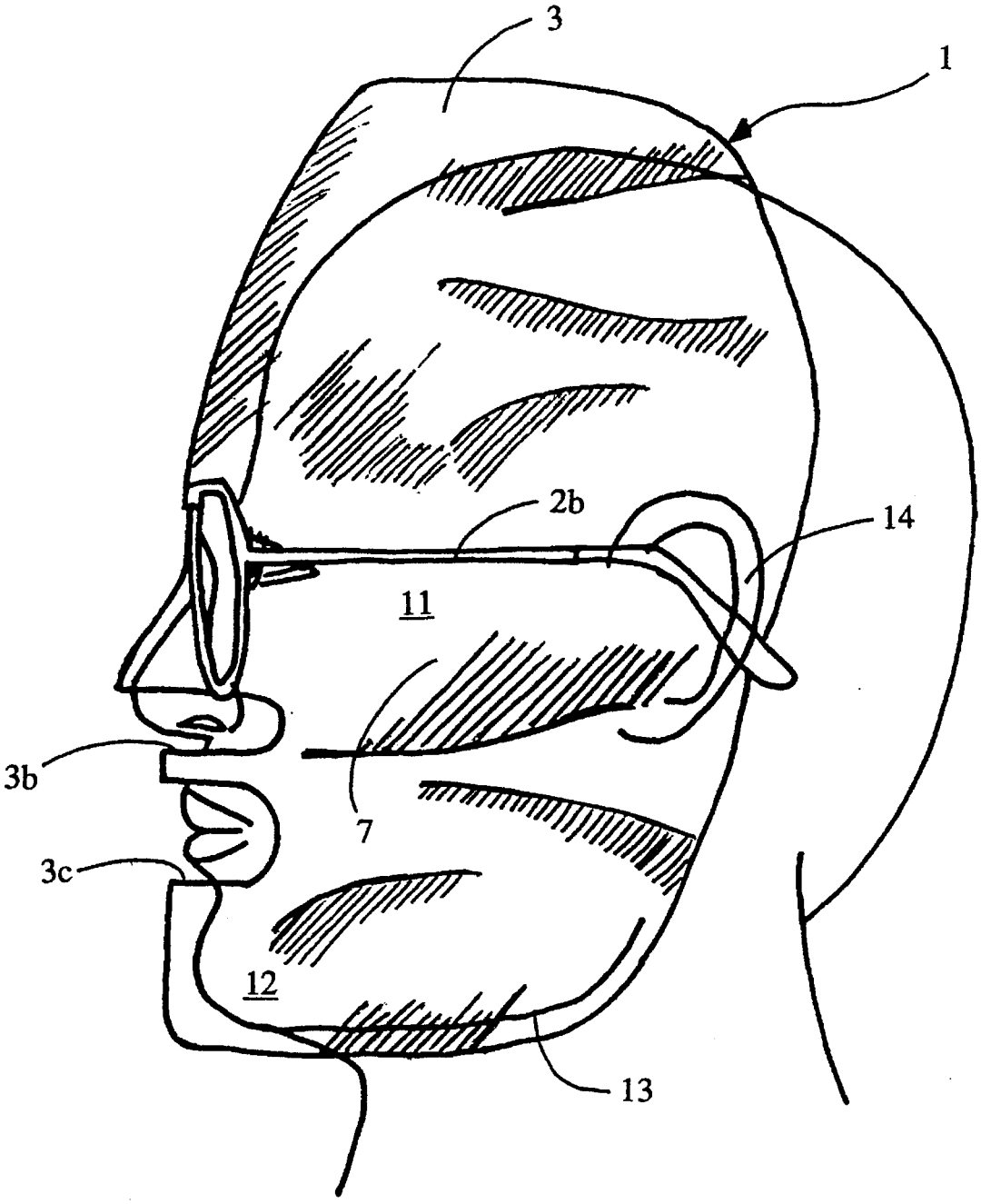
FIG. 2 is a side view of the first embodiment of the present antiphotoaging face mask.

Referring to FIGS. 1 and 2, a first embodiment of the present antiphotoaging mask is shown. Mask 1 includes sunglasses 2 having a front frame portion 2*a* receiving lenses 2*c* and temples 2*b* extending therefrom, temples 2*b* being seated along the earlobes 14 of the wearer in a known manner. Flexible plastic wrap 3 includes a front portion 8 that covers at least the nose of the wearer, and lateral side portions 7 that cover the lateral aspects 11 of the head of the wearer. In addition, flexible plastic wrap 3 extends to cover the forehead 10, chin 12, jawline 13 and earlobes 14 of the wearer. As shown, the flexible plastic wrap 3 is secured to an outer periphery of the front frame portion 2*a*, leaving lens openings 3*a* to ensure unobstructed vision by the wearer. Additionally, ventilation is improved by provision of nose opening 3*b* and mouth opening 3*c*. Nose opening 3*b* and mouth opening 3*c* may be combined into a single opening.

Coverage of the nose and lateral aspects of the head (cheeks) of the wearer is a particularly important feature of the present invention, since such areas are typically exposed to intense and direct sunlight. Accordingly, where the maximuum UV protection afforded by the full plastic wrap of the first embodiment is not needed, an embodiment utilizing a partial plastic wrap may be utilized, as discussed below.

Figure 3:
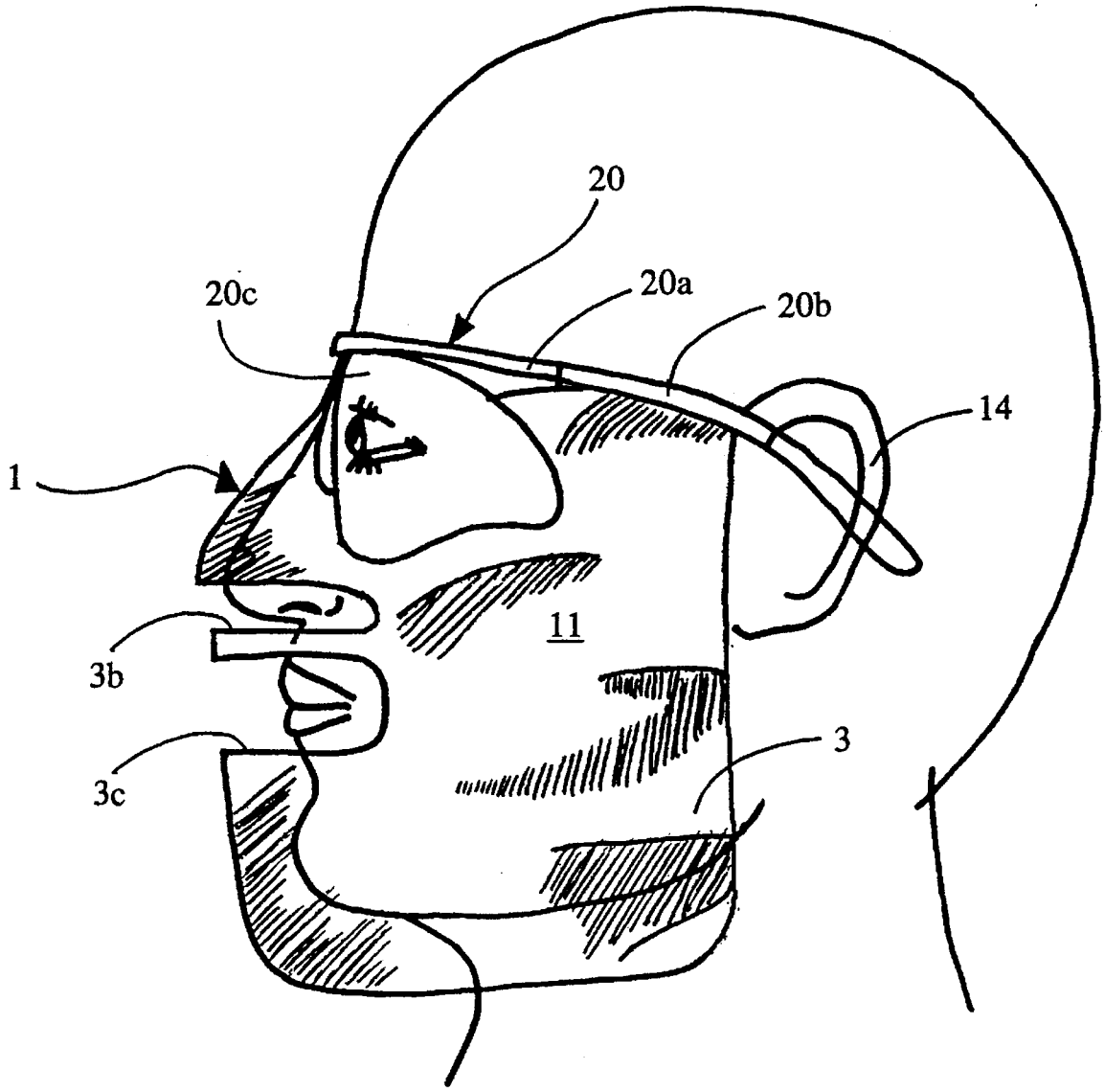
FIG. 3 is a side view of a second embodiment of the present antiphotoaging face mask, incorporating sports-type sunglasses and a partial flexible plastic wrap.
Figure 4:
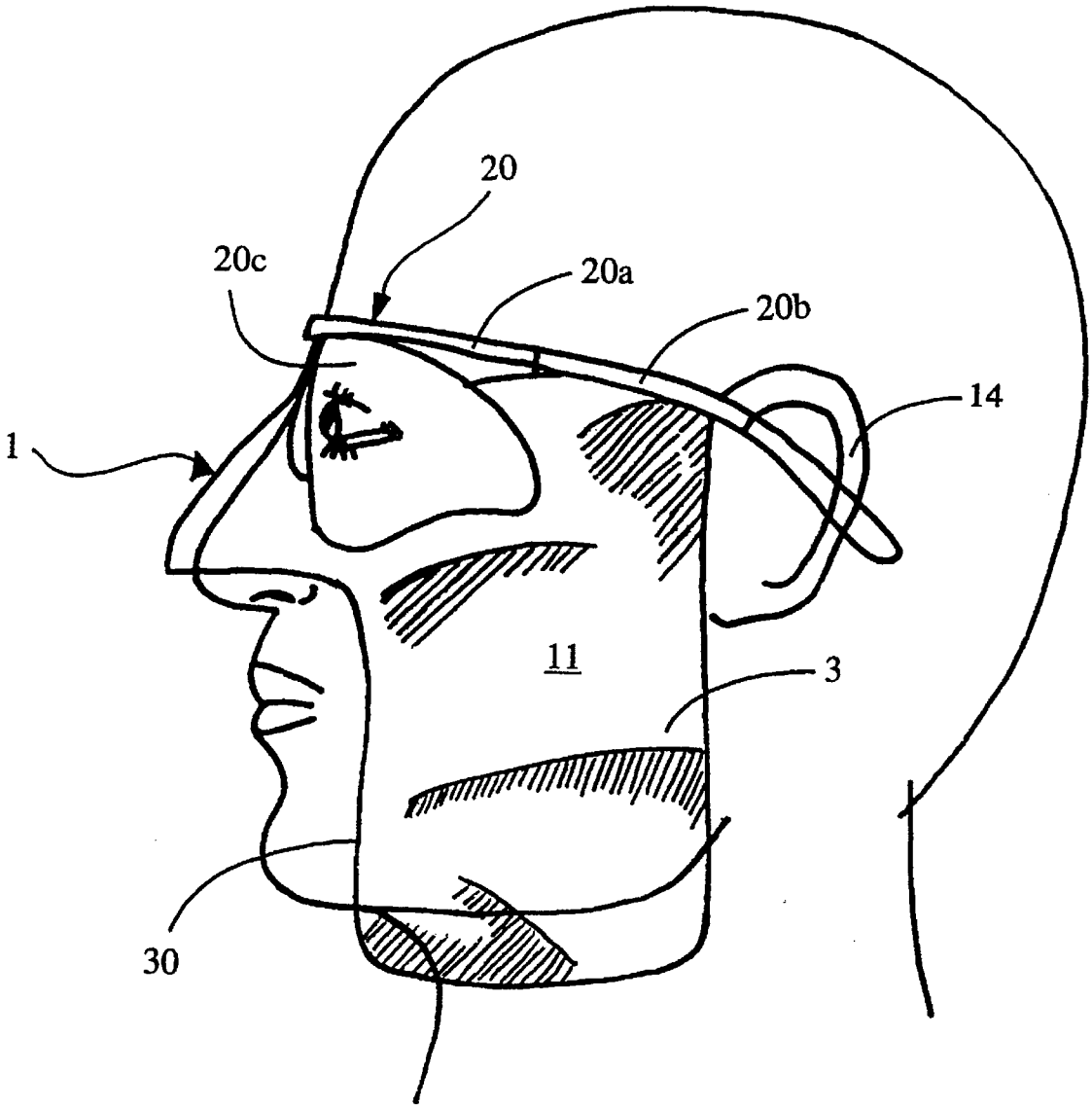
FIG. 4 is a side view of a third embodiment of the present antiphotoaging face mask that is similar to that shown in FIG. 3, but which utilizes a contoured cut-out around the nostril openings and mouth of the wearer.

Turning to the second and third embodiments shown in FIGS. 3 and 4, respectively, a similar antiphotoaging mask 1 is shown. However, in this embodiment, sports sunglasses 20 are employed, including an arcuate frame portion 20*a*, temples 20*b* and one-piece lens 20*c*. The flexible plastic wrap 3 in this embodiment does not extend substantially above the sunglasses 2, but rather, extends only downward to cover the nose, lateral aspects 11 and, optionally, the earlobes 14 of the wearer. The flexible plastic wrap 3 is secured to an outer periphery of one-piece lens 20*c*, and along the temples 20*b*.

In the second embodiment shown in FIG. 3, the flexible plastic wrap 3 extends down and covers the chin of the wearer. In contrast, the flexible plastic wrap 3 of the third embodiment shown in FIG. 4 includes a cut-out 30 that exposes the mouth and at least the nostril openings of the wearer. The third embodiment shown in FIG. 4 is particularly advantageous for sports activities where it is important to maintain maximum ventilation while still offering increased protection from the sun normally not afforded by standard sunglasses.

In all embodiments, the flexible plastic wrap 3 may contain tiny perforations for increased breathability.

While the present invention has been developed to replace sunscreens, certain people may opt to use sunscreens in addition to the present antiphotoaging mask for maximum protection. The material of the flexible plastic wrap may he chosen by one of ordinary skill in the art, so long as the plastic material has adequate absorption properties for UVA, UVB and UVC radiation.

The present antiphotoaging mask provides not only protection from the sun, hut also may help rejuvenate already damaged facial skin by shielding such damaged skin (e.g., along the bridge of the nose or cheeks) from additional harmful radiation.

While the present antiphotoaging face mask has been illustrated by numerous preferable embodiments, it is to be understood that modifications may be made thereto by one of ordinary skill in the art without departing from the spirit and scope of the invention as defined in the appended claims.

What is claimed is:

1. An antiphotoaging face mask adapted to protect the skin along the face of a wearer from sun damage, comprising:

an integrated structure including a frame and a one-piece plastic wrap permanently attached thereto, said frame including a front frame portion, a pair of temples extending therefrom that seat along the earlobes of the wearer, and a nosebridge extending from the front frame portion, said wrap being secured to the frame along said front frame portion, said wrap being curved along a longitudinal direction so as to cover the nose and lateral aspects of the face of the wearer, and being curved along a latitudinal direction, perpendicular to the longitudinal direction, such that the wrap covers the forehead of the wearer and generally follows an outer contour of the forehead, the entirety of the wrap being comprised of a plastic material that blocks at least harmful UV rays from the sun.

2. The antiphotoaging face mask of claim 1, wherein said plastic wrap is perforated.

3. The antiphotoaging face mask of claim 1, wherein the plastic wrap extends laterally to cover the earlobes of the wearer.

4. The antiphotoaging face mask of claim 1, wherein the plastic wrap extends to cover the chin of the wearer.

5. The antiphotoaging face mask of claim 4, wherein the plastic wrap includes a mouth hole.

6. The antiphotoaging face mask of claim 1, wherein the plastic wrap includes a nose hole.

* * * * *